United States Patent [19]

Stolzman

[11] Patent Number: 4,805,798

[45] Date of Patent: Feb. 21, 1989

[54] CONTAINER AND CLOSURE HAVING FASTENING MEANS

[75] Inventor: Michael D. Stolzman, Lake Forest, Ill.

[73] Assignee: International Precision Components Corporation, Lake Forest, Ill.

[21] Appl. No.: 188,365

[22] Filed: Apr. 29, 1988

Related U.S. Application Data

[63] Continuation-in-part of Ser. No. 64,673, Jun. 22, 1987, Pat. No. 4,741,453.

[51] Int. Cl.[4] ..... B65D 45/00

[52] U.S. Cl. ..... 220/315; 220/320

[58] Field of Search ..... 220/315, 319, 320; 229/5.7

[56] References Cited

U.S. PATENT DOCUMENTS

| | | | |
|---|---|---|---|
| 3,223,278 | 12/1965 | Allen | 220/320 |
| 4,158,423 | 6/1979 | Starr | 220/320 |
| 4,305,535 | 12/1981 | Brundige et al. | 229/5.7 |
| 4,377,245 | 3/1983 | Patty | 220/319 |
| 4,741,453 | 5/1988 | Stalzman | 220/315 |

*Primary Examiner*—George T. Hall

*Attorney, Agent, or Firm*—Wood, Dalton, Phillips Mason & Rowe

[57] ABSTRACT

A container having a tubular sidewall. A closure is mounted to one end of the sidewall by molding in situ. The sidewall end portion is provided with an array of circumferentially spaced through openings, and the closure includes a U-shaped connecting portion having a pair of spaced legs on opposite sides of the end portion, with securing portions extending between the legs through the openings. The closure is injection molded so as to clamp the end portion of the tubular element between the legs and sealingly connect the closure thereto. At the opposite end, a connecting ring is formed in situ on the end portion of the tubular element in the same manner as the connecting portion of the first described closure. The connecting ring includes a radially outwardly opening annular recess adapted to receive an inturned complementary flange on a removable closure member. The flange is split and the removable closure member is provided with a pair of tabs. Different forms of constricting and locking structure for cooperation with the tabs are disclosed, including such structure adapted to be utilized without the need for tools.

15 Claims, 3 Drawing Sheets

FIG. 1
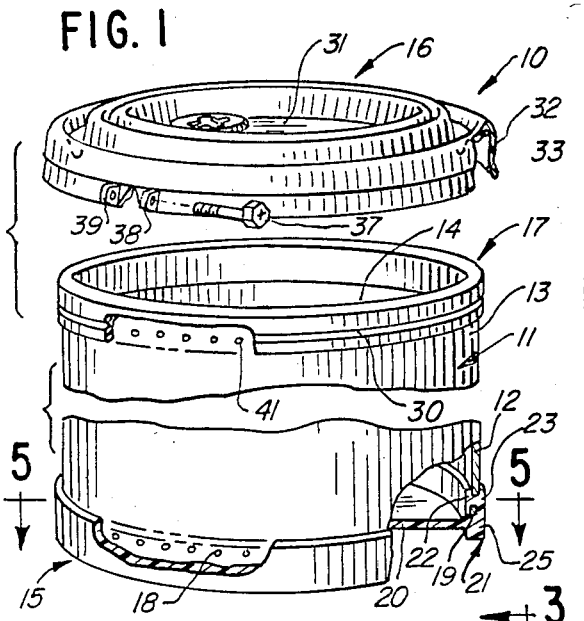
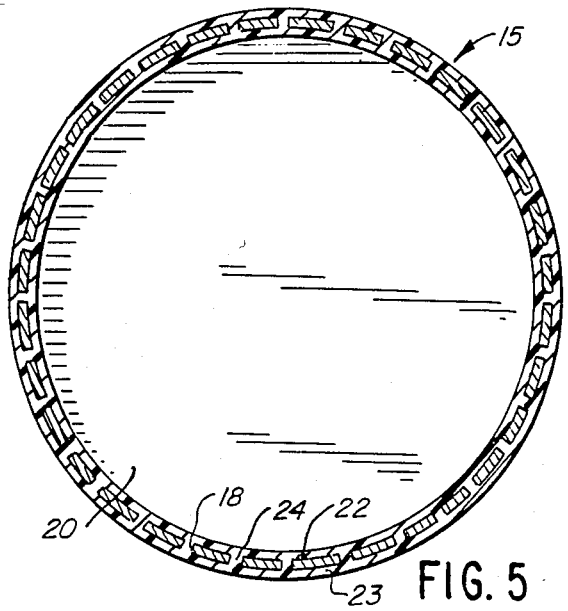
FIG. 5
FIG. 2
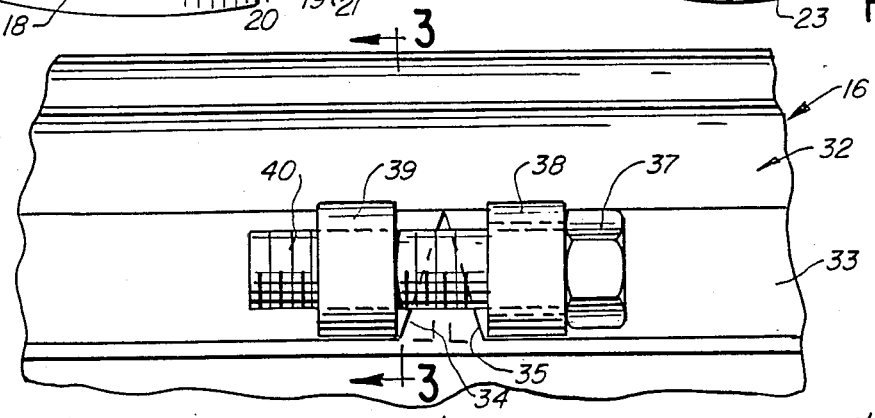
FIG. 3
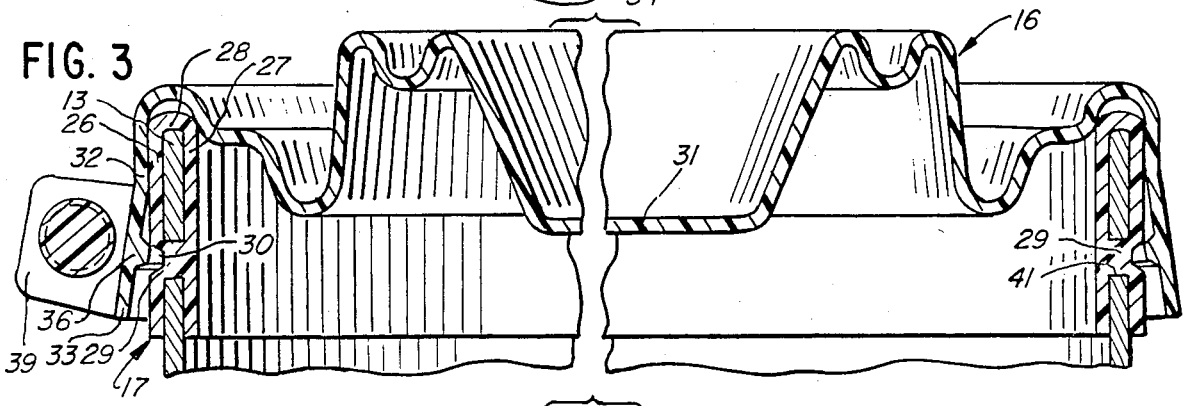
FIG. 4
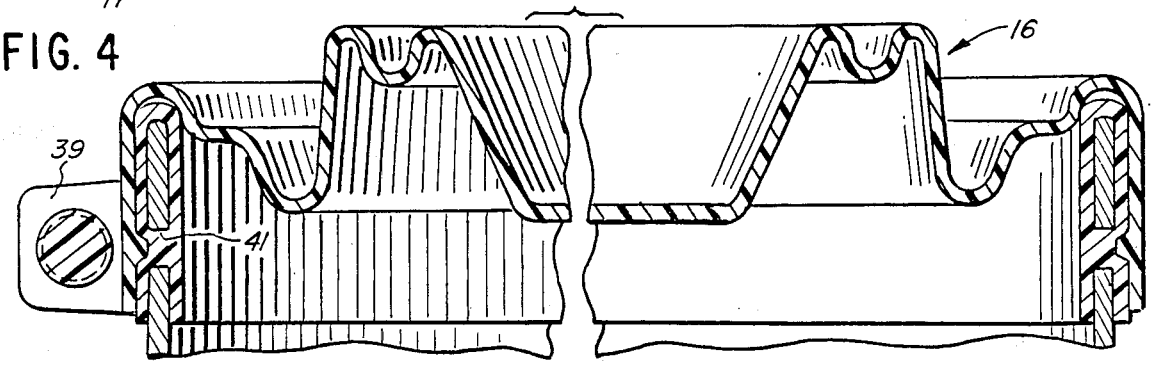

CONTAINER AND CLOSURE HAVING FASTENING MEANS

CROSS-REFERENCE TO RELATED APPLICATIONS

This application comprises a continuation-in-part of my copending application Ser. No. 064,673, filed June 22, 1987, entitled "Container", now U.S. Pat. No. 4,741,453.

TECHNICAL FIELD

This invention relates to containers and in particular to containers having a tubular sidewall.

BACKGROUND ART

In one form of conventional shipping and storage container, a tubular sidewall is formed of fibrous material. It is conventional to provide metal securing rings at opposite ends of the sidewall for securing closure walls thereacross. Such metal securing rings are relatively costly and heavy and are not fully satisfactory in the formation of a low cost shipping and storage container.

DISCLOSURE OF INVENTION

The present invention comprehends an improved container having a tubular sidewall defining opposite open ends.

The invention comprehends closing one end of the container by means of a closure molded of synthetic resin in situ in association with the end portion of the sidewall threat, the closure having a transverse center wall portion extending across the open end of the tubular sidewall, and a U-shaped annular peripheral connecting portion extending adjacent the end portion of the sidewall and defining spaced annular legs embracing the end portion. The connecting portion further includes a plurality of securing portions extending between the legs and through a plurality of circumferentially spaced openings in the sidewall end portion.

The invention further comprehends the provision of an improved removable cover for closing one end of the tubular sidewall. The removable closure means includes a connecting ring molded of synthetic resin in situ in association with the end portion of the sidewall and comprising a U-shaped annular element defining spaced annular legs embracing the sidewall end portion and having a plurality of securing portions extending between the legs through circumferentially spaced openings provided in the sidewall end portion. The connecting ring includes a radially outwardly opening annular recess and a closure is removably mounted to the connecting ring by a portion thereof removably interlocked with the connecting ring in the recess.

In one illustrated embodiment, the closure is formed of a molded synthetic resin and includes a transverse center wall. The portion of the closure interlocked with the connecting ring comprises a radially inwardly projecting split peripheral flange removably received in the annular recess of the connecting ring for retaining the closure to the connecting ring across the open end of the space.

The closure, in said one illustrated embodiment, includes a pair of radially outturned tabs at the opposite ends of the split annular flange and means are provided for adjustably drawing the tabs towards each other to constrict the flange into the annular recess of the connecting ring.

The invention comprehends the forming of the closures and connecting ring as by injection molding of suitable synthetic resin, such as high density polyethylene. The forming of the closure at one end of the tubular element and the connecting ring at the opposite end thereof by molding in situ these elements in related association with the opposite ends of the tubular element provides a low cost, substantially improved container structure.

In said one illustrated embodiment, the means for adjustably drawing the outturned tabs towards each other to constrict the flange comprises bolt means.

In a second illustrated embodiment of the invention, the means for adjustably drawing the tabs toward each other comprises a lever and connecting link means.

In the second illustrated embodiment, the tabs are provided with oppositely outwardly opening recesses adapted to cooperate with a portion of the lever and a portion of the connecting link, respectively, so as to retain the closure on the drum by an overcenter disposition of the lever and link means.

The container structure of the present invention is extremely simple and economical, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary exploded view of a container embodying the invention;

FIG. 2 is a fragmentary enlarged elevation of a portion of the removable closure;

FIG. 3 is a fragmentary transverse section taken substantially along the line 3—3 of FIG. 2;

FIG. 4 is a fragmentary section similar to that of FIG. 3, but with the removable closure secured to the connecting ring;

FIG. 5 is a transverse section taken substantially along the line 5—5 of FIG. 1;

BEST MODE FOR CARRYING OUT THE INVENTION

Figure 6:
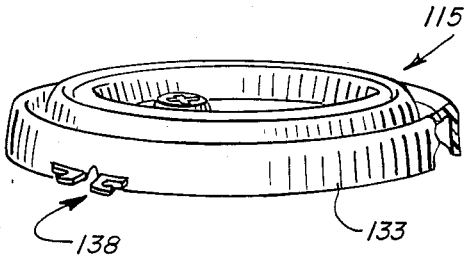
FIG. 6 is a fragmentary perspective view of another form of enclosure embodying the invention.
Figure 8:
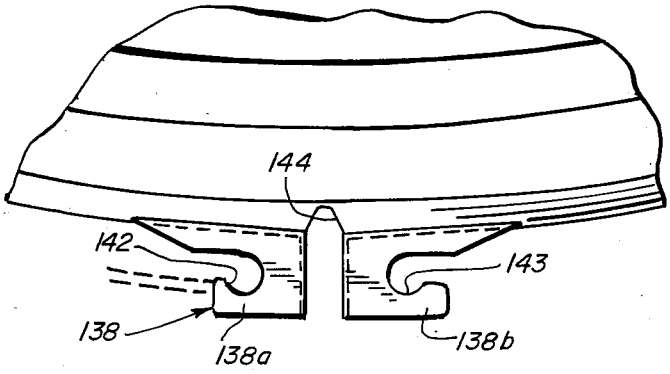
FIG. 8 is a fragmentary enlarged top plan view thereof.

In the illustrative embodiment of the invention as disclosed in FIGS. 1–5 of the drawing, a container generally designated 10 is shown to include a fibrous tubular sidewall 11. In the illustrated embodiment, the sidewall defines a right cylinder, it being understood that the sidewall may define other suitable configurations, such as square, oval, etc.

The sidewall defines a lower end portion 12 and an upper end portion 13. The tubular sidewall defines an internal storage space 14. The lower end of the storage space 14 is closed by a closure generally designated 15 fixedly secured to the sidewall end portion 12, as seen in FIG. 1. The open upper end of the space 14 is selectively closed by a second closure generally designated 16 removably secured to a connecting ring generally designated 17 fixedly secured to the upper end portion 13 of the sidewall.

As seen in FIGS. 1 and 5, sidewall end portion 12 is provided with an array of through openings 18 adjacent the distal end 19 thereof. Openings 18 are equidistantly circumferentially spaced about the sidewall end portion 12.

Closure 15 comprises a unitary element molded of a suitable synthetic resin, such as high density polyethylene. The closure is molded in situ in association with the sidewall end portion 12 and defines a transverse center wall portion 20 closing the lower end of the container space 14.

Closure 15 further defines a peripheral connecting portion generally designated 21 extending adjacent the sidewall end portion 12. As seen in FIG. 1, the connecting portion comprises a U-shaped annular peripheral portion of the closure defining spaced annular legs 22 and 23 embracing the distal end of the sidewall end portion 12 and having a plurality of securing portions 24 extending between legs 22 and 23 through the openings 18 for securing the closure 15 to the sidewall end portion 12.

As shown in FIG. 1, the openings 18 are circular and are spaced a preselected distance outwardly from the distal end 19 of the sidewall end portion. As further shown in FIG. 1, the closure 15 may include a downturned annular peripheral flange 25 extending oppositely to the legs 22 and 23, such as for use in stacking the closed containers.

Legs 22 and 23 may comprise relatively thin wall flanges, illustratively having a thickness of approximately 0.100". The center wall portion 20 may have a thickness greater than that of the legs, as desired.

The closure 15 may be formed in situ on the sidewall end portion 12 as by injection molding thereof. Such formation of the closure provides improved connection of the closure to the sidewall by affording a sealed facial engagement with the sidewall end portion. The pressure applied to the fluid synthetic resin effects a compression of the sidewall end portion, thereby providing a positive sealed connection of the closure to the end portion, with the closure securing portions 24 maintaining the closure against longitudinal displacement from the sidewall end portion 12 and, in cooperation with the clamped embracing of the sidewall end portion by the closure legs, provides a positive sealed connection of the closure to the sidewall at end portion 12.

As discussed above, closure 16, at the opposite end of the tubular sidewall, is secured to the end portion 13 through the connecting ring 17. The connecting ring is molded of synthetic resin in situ in association with the end portion 13 and is generally similar to connecting portion 21 of closure 15.

More specifically, sidewall end portion 13 is provided with an array of through openings 41 similar to openings 18 in end portion 12. The connecting ring defines a pair of legs 26 and 27 joined by the bight 28 so as to embrace sidewall end portion 13, as illustrated in FIG. 3.

Connecting ring 17 further includes a plurality of securing portions 29 extending through the openings 41. The connecting ring is preferably molded in situ to the tubular sidewall end portion 13 as by injection molding so as to secure the connecting ring to the sidewall end portion 13 in sealed, clamped association similar to the association between connecting portion 21 of closure 15 and the opposite sidewall end portion 12.

Connecting ring 17 further defines a peripheral, radially outwardly opening annular recess 30 having an outwardly widening trapezoidal cross section. Closure 16 includes a central portion 31 and a peripheral depending thin wall 32. The lower distal portion 33 of wall 32 comprises a split annular portion having opposed ends 34 and 35, as shown in FIG. 2. Wall portion 33, as shown in FIG. 3, is further provided with a radially inwardly projecting flange 36, which is correspondingly split.

Flange 36 has a radially inwardly narrowing frustoconical cross section complementary to the cross section of recess 30 and is adapted to be removably received in the recess as a result of constriction of the split annular wall portion 33.

Constriction of the wall portion 33 is effected by threaded adjustment of a bolt 37 through a pair of radially outwardly projecting tabs 38 and 39 on split wall portion 33 adjacent the spaced ends 34 and 35 thereof. As shown in FIG. 2, the shank 40 of bolt 37 extends freely through tab 38 and is threaded into tab 39 to provide the desired adjustable drawing together of the tabs 38 and 39 in securing the closure 16 to the connecting ring 17.

The container structure of the present invention provides low cost provision of the end wall closure at one end of the tubular element and removable mounting of the closure to the opposite end of the tubular sidewall element, with positive sealed connection of the closures to the sidewall ends without the need for the costly and heavy metal closure connecting means of the prior art. Further, the metal connecting means of the prior art has required the forming of the ends of the tubular sidewall to conform with the unique configuration of the metal securing means. The present invention eliminates the need for such forming and utilizes, in lieu thereof, the array of threadedly formed through openings 18 and 41.

Referring now to the embodiment of FIGS. 6–15, a modified form of closure generally designated 115 is shown to include a pair of tabs 138. Tabs 138 differ from tabs 38 in that tab 138*a* is provided with a circumferentially opening recess 142 and tab 138*b* is provided with an oppositely opening circumferential recess 143. As shown, the wall of the respective tabs extends more than 180° about the recesses so as to define an undercut configuration.

Figure 7:
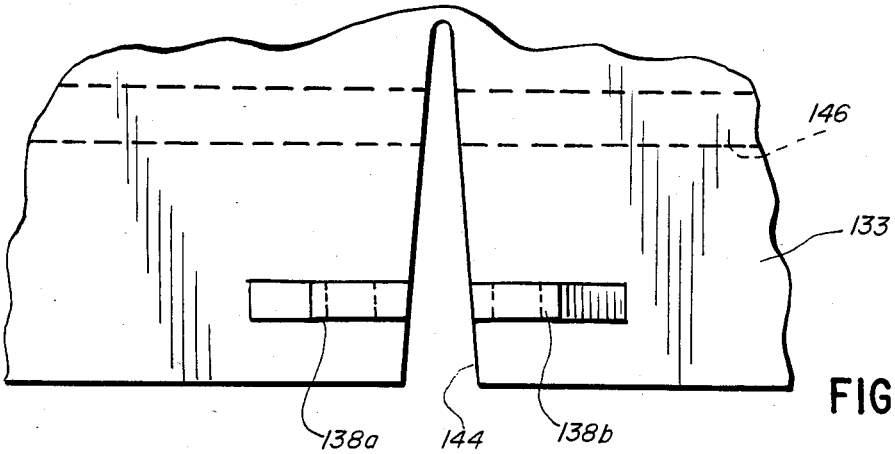
FIG. 7 is a fragmentary enlarged side elevation thereof.
Figure 9:
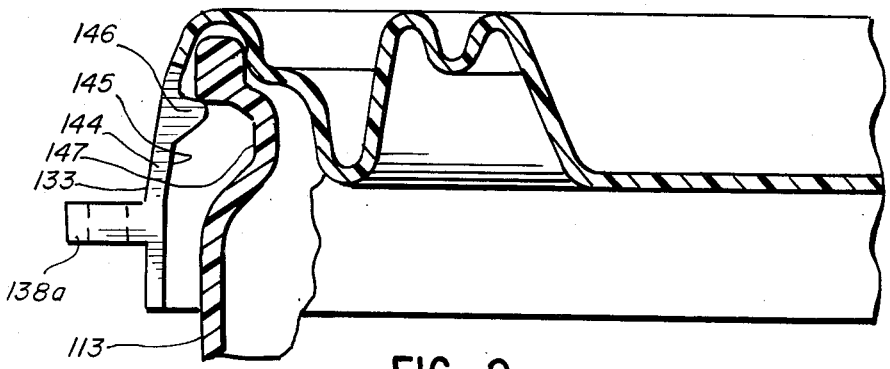
FIG. 9 is a fragmentary enlarged vertical section illustrating the initial mounting of the closure on the end of a drum prior to the constrictive retention of the closure thereto.
Figure 10:
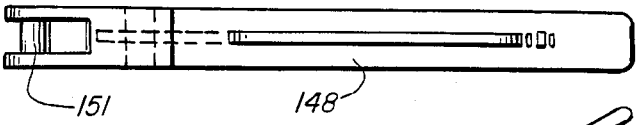
FIG. 10 is a top plan view of the lever of the retaining means thereof.
Figure 11:
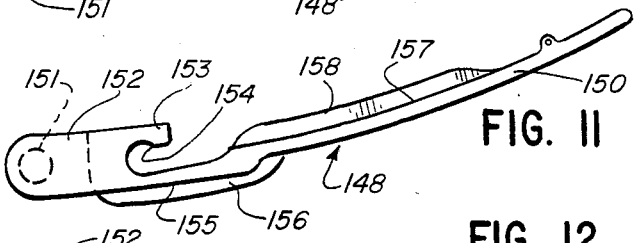
FIG. 11 is a side elevation of the lever.
Figure 12:
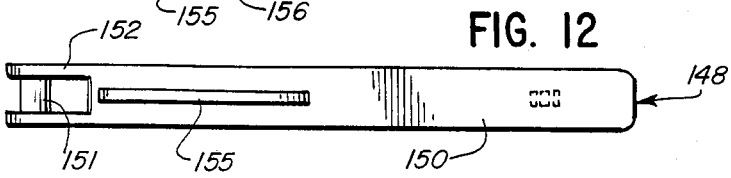
FIG. 12 is a bottom plan view of the lever.
Figure 13:
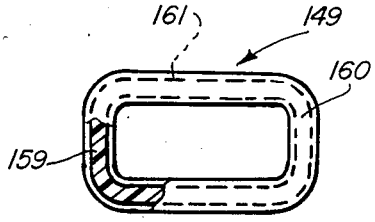
FIG. 13 is a fragmentary elevation of the loop of the retaining means.

The distal wall portion 133 is provided with a downwardly widening notch 144 between the tabs, as best seen in FIG. 7.

The inner surface 145 of the closure wall portion 133 is provided with an inwardly projecting rib 146 adapted to fit into an outwardly opening annular recess 147 in the end of the drumwall 113. Thus, constriction of the closure wall portion 133 so as to close notch 144 causes a corresponding construction of the rib 146 into the groove 147 to retain the closure on the end of the drum in the same manner as rib 36 cooperates with the annular recess 30 in closure 15.

Figure 15:
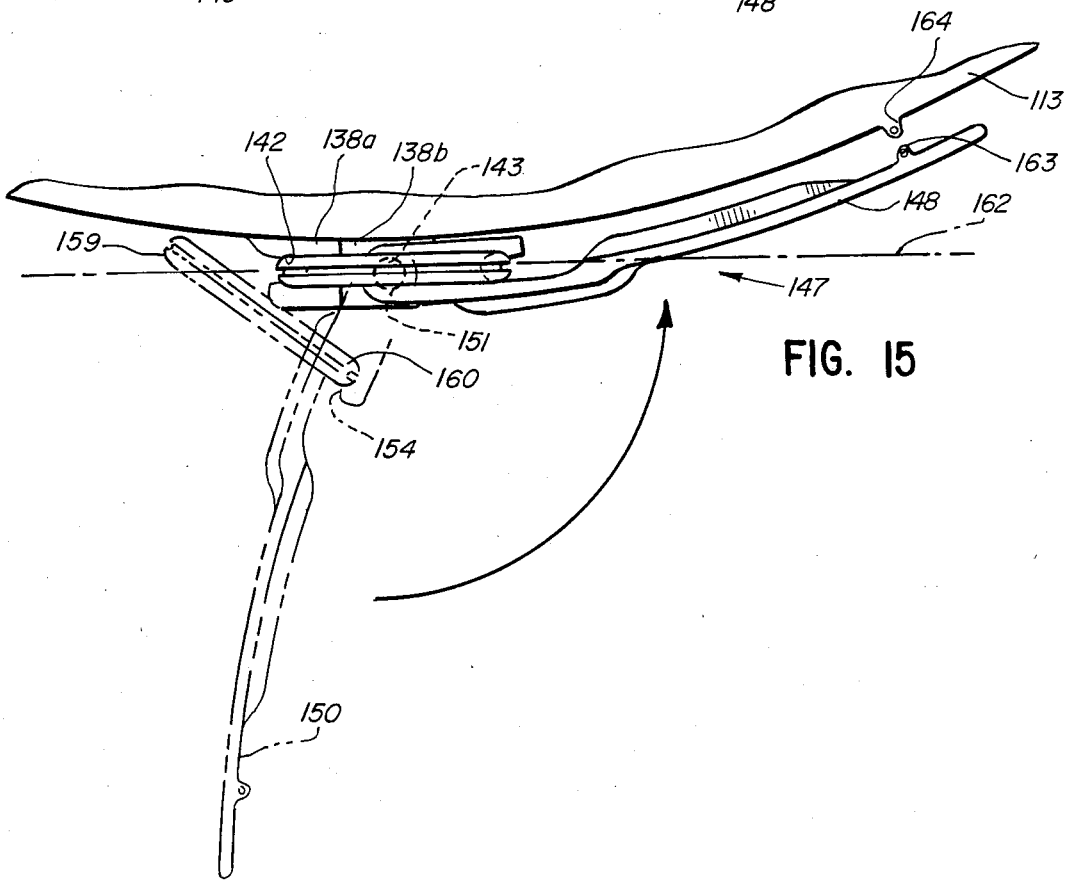
FIG. 15 is a fragmentary top plan view illustrating the movement of the lever and link from an initial position in dotted lines to the locking position in full lines.

Constriction of the wall portion 133 is effected by drawing together the spaced tabs 138*a* and 138*b* from the spaced position of FIG. 7 to the juxtaposed position shown in full lines in FIG. 15.

The means for constricting the wall portion 133 comprises a retaining means generally designated 147. The retaining means includes a lever 148 and a loop element 149.

Lever 148 includes a handle portion 150 at one end, a cylindrical pivot 151 mounted to a bifurcated opposite end 152 of the lever.

A hook portion 153 is provided at end 152 and defines an outwardly opening recess 154, which is similar to the recesses 142 and 143 in having a circular cross section extending slightly more than 180°.

The lever defines an outer surface 155 provided with an outwardly projecting longitudinally extending rib 156, and an inner surface 157 provided with an inwardly projecting longitudinally extending rib 158.

Loop element 149 defines opposite rectilinearly extending ends 159 and 160. The loop element 149 may be provided with a peipheral outwardly opening recess 161.

Retaining means 147 is mounted to the tabs 138 by firstly positioning loop element end 159 in recess 142 of the tab 138*a* with the pivot 151 of the lever received in the recess 143 of the opposite tab 138*b*, and the opposite end 160 of the loop element received in the recess 154 of the lever hook portion 153, as illustrated in broken lines in FIG. 15.

Figure 14:
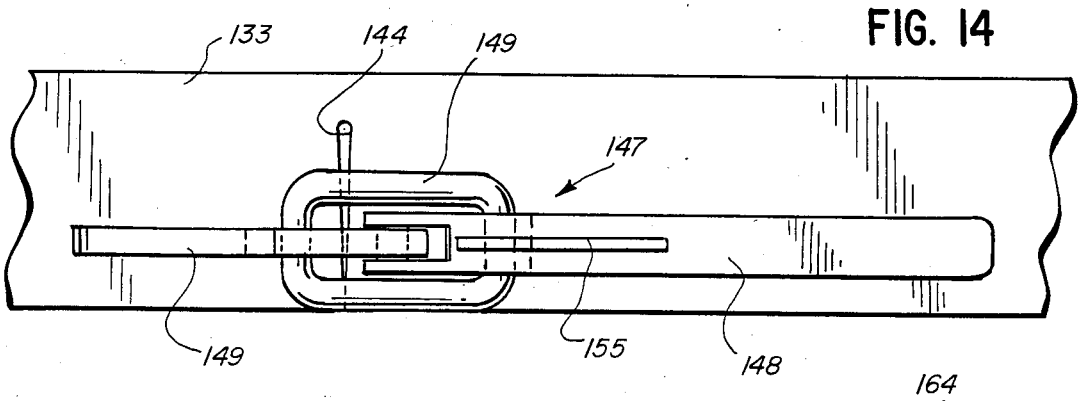
FIG. 14 is a fragmentary side elevation illustrating the arrangement of the retaining means on the tabs of the closure in the locked disposition.

Handle portion 150 of the lever is then pivoted in a counterclockwise direction, as seen in FIG. 15, with the pivot rotating in recess 143 of tab 138*b*, to an overcenter position wherein a line 162 drawn through the center of the loop element ends 159 and 160 lies inwardly of the axis of the pivot 151, as seen in full lines in FIG. 15. The spacing of the recess 154 from the axis of the pivot 151 of lever 148 is correlated with the length of the loop element between ends 159 and 160 so that the notch 144 is constricted to a substantially closed disposition, as seen in FIG. 14, with the handle in the overcenter locking diposition of FIG. 14 (and full line disposition in FIG. 15).

As further shown in FIG. 15, the lever handle portion 148 is spaced outwardly of the drum wall 113 in the locking disposition so as to facilitate release of the locking means, when desired, by insertion of the user's fingers between the handle portion 148 and the drum wall portion 113. However, as a result of the overcenter locking arrangement, the closure is positively retained in association with the drum end under a substantial locking force acting between the loop element end 159 and pivot 151 received in the tab recesses 142 and 143, respectively.

The improved form of constricting and locking means of the embodiment of FIGS. 6–15 provides the advantage of permitting the locking of the closure to the drum end without the need for tools. Thus, in many applications, the retaining means of FIGS. 6–15 comprises a preferred embodiment thereof.

Lever handle portion 148 may be provided with an inwardly extending projecting 163 adjacent the distal end thereof for limiting the inward movement of the handle portion and thereby avoiding pinching of the user's fingers in swinging the lever to the overcenter locking position. As further shown in FIG. 15, if desired, drum wall liner 13 may be provided with an outwardly projecting similar projection 164.

Other than as discussed above, the constricting and locking means of the embodiment of FIGS. 6–15 functions in a manner similar to the constricting and locking means of the embodiment of FIGS. 1–5.

The foregoing disclosure of specific embodiments is illustrative of the broad inventive concepts comprehended by the invention.

I claim:

1. A closure for use with a container having an annular end portion defining a radially outwardly opening annular recess, said closure comprising:

a unitary wall element formed of molded synthetic resin and having a transverse center wall, and a peripheral portion comprising a split annular flange having spaced end portions and radially inwardly projecting securing structure; and means for constricting the flange to urge the securing structure radially inwardly, said securing structure being adapted to be fitted into an annular recess of a container end portion as a result of such constriction of the flange, said means for constricting the flange comprising a pair of radially outturned tabs adjacent said flange end portions, and retaining means movable to an overcenter position for adjustably drawing said tabs toward each other and releasably locking said securing structure in said annular recess when said retaining means is in said overcenter position.

2. The closure of claim 1 wherein said flange includes a downwardly widening notch defining the split portion thereof.

3. The closure of claim 1 wherein said flange includes a downwardly widening triangular notch defining the split portion thereof.

4. The closure of claim 1 wherein said flange includes a continuously annular upper portion and a discontinuous, split lower portion.

5. The closure of claim 1 wherein said flange includes a downwardly widening notch defining the split portion thereof, and said tabs are formed unitarily integrally with said flange at opposite sides of said notch.

6. A closure for use with a container having an annular end portion defining a radially outwardly opening annular recess, said closure comprising:

a unitary wall element formed of molded synthetic resin and having a transverse center wall, and a peripheral portion comprising a split annular flange having spaced end portions and radially inwardly projecting securing structure; and means for constricting the flange to urge the securing structure radially inwardly, said securing structure being adapted to be fitted into an annular recess of a container end portion as a result of such constriction of the flange, said means for constricting the flange comprising a pair of radially outturned tabs adjacent said flange end portions, and retaining means movable to an overcenter position for adjustably drawing said tabs toward each other and releasably locking said securing structure in said annular recess when said retaining means is in said overcenter position, said retaining means comprising a loop element having a first portion embracing one of said tabs, and an opposite second portion, and a lever having a first portion partially engaging the other of said tabs, and a second portion embracing said second portion of the loop element being disposed in an overcenter disposition relative to a line through said first portion of the loop element and said first portion of the lever in said overcenter position of said retaining means.

7. The closure of claim 6 wherein said first and second portions of the loop element comprise parallel rectilinear portions.

8. The closure of claim 6 wherein said tabs define circular openings facing outwardly away from each other, said tabs extending about said openings greater than 180°.

9. The closure of claim 6 wherein said tabs define circular openings facing outwardly away from each other, said tabs extending about said openings greater than 180°, said first portion of the loop element having a circular cross section and being received in the opening of one of said tabs, said first portion of the loop element having a diameter substantially equal to the diameter of the circular opening in which it is received.

10. The closure of claim 6 wherein said tabs define circular openings facing outwardly away from each other, said tabs extending about said openings greater than 180°, said first portion of the lever having a circular cross section and being received in the opening of one of said tabs, said first portion of the lever having a diameter substantially equal to the diameter of the circular opening in which it is received.

11. The closure of claim 6 wherein said tabs define circular openings facing outwardly away from each other, said tabs extending about said openings greater than 180°, said first portion of the loop element having a circular cross section and being received in the opening of one of said tabs, said first portion of the loop element having a diameter substantially equal to the diameter of the circular opening in which it is received, said first portion of the lever having a circular cross section and being received in the opening of the other of said tabs, said first portion of the lever having a diameter substantially equal to the diameter of the circular opening in which it is received.

12. The closure of claim 6 wherein said lever comprises an elongated member defining an outer surface, an inner surface, and opposite ends, said second portion of the lever extending inwardly from said inner surface at one of said ends.

13. The closure of claim 6 wherein said lever comprises an elongated member defining an outer surface, an inner surface, and opposite ends, said second portion of the lever extending inwardly from said inner surface at one of said ends, said lever having a longitudinally extending rib on said outer surface outwardly of said second portion thereof.

14. The closure of claim 6 wherein said lever comprises an elongated member defining an outer surface, an inner surface, and opposite ends, said second portion of the lever extending inwardly from said inner surface at one of said ends, said first portion of the lever being disposed at a distal portion of said one of said ends.

15. The closure of claim 6 wherein said lever comprises an elongated member defining an outer surface, an inner surface, and opposite ends, said second portion of the lever extending inwardly from said inner surface at one of said ends, said lever having a first, longitudinally extending rib on said outer surface outwardly of said second portion thereof, and a second, longitudinally extending rib on said inner surface adjacent the other of said opposite ends.

* * * * *